US005473969A

United States Patent [19]

Chen

[11] Patent Number: 5,473,969

[45] Date of Patent: Dec. 12, 1995

[54] TRANSMISSION MECHANISM FOR MUSIC BOX DISPLAY DEVICES

[76] Inventor: Corrina Chen, 8F, No. 185, Yung Chi Road, Taipei, Taiwan

[21] Appl. No.: 434,141

[22] Filed: May 2, 1995

[51] Int. Cl.[6] ..... G10F 1/06

[52] U.S. Cl. ..... 84/95.2

[58] Field of Search ..... 84/94.2, 95.2

[56] References Cited

U.S. PATENT DOCUMENTS 5,070,753 10/1991 Hou ..... 84/95.2

5,161,420 11/1992 Feng ..... 84/95.2 X

*Primary Examiner*—Patrick J. Stanzione

*Attorney, Agent, or Firm*—Pro-Techtor International

[57] ABSTRACT

A transmission mechanism including a seesaw balanced in a box inside a decorative housing and coupled to the power output shaft of a music box inside the housing by a crankshaft, and two tappet rods coupled to two opposite ends of the seesaw to support a respective ornament outside the housing, wherein the tappet rods with the ornaments are alternatively reciprocated when the music box is operated to produce certain tunes and to simultaneously rotate the crankshaft in oscillating the seesaw back and forth.

3 Claims, 3 Drawing Sheets

TRANSMISSION MECHANISM FOR MUSIC BOX DISPLAY DEVICES

BACKGROUND OF THE INVENTION

The present invention relates to music boxes, and relates more specifically to such a transmission mechanism coupled to the power output shaft of a music box by a crankshaft to move ornaments by tappet rods through a seesaw.

Various transmission mechanisms have been disclosed for transmitting the power output of a music box to ornaments supported thereon. For example: TRANSMISSION MECHANISM FOR MUSIC BOX ORNAMENT of U.S. Pat. No. 4,939,944 uses the output shaft of the music box to rotate an eccentric stub that is engaged within a slide link supported for vertical movement on a pair of guide rods, wherein the ornament is supported by a tappet rod having a lower end secured to either the slide link or the drive stub, so that operation of the music box will impart the desired movement to the ornament; ORNAMENT DISPLAY ASSEMBLY of U.S. Pat. No, 4,890,828 uses the wind-up shaft of a wind-up music box mechanism to rotate a first ornament, and to reciprocate second and third ornaments supported on tappet rods engaged by a pair of offset eccentric cam members mounted on a drive shaft driven by the mechanism.

SUMMARY OF THE INVENTION

The present invention provides a transmission mechanism coupled to the power output shaft of a music box for imparting alternating vertical movements to a pair of ornaments supported on a respective tappet rod. The power transmission is achieved by coupling the tappet rods to the power output shaft of the music box through a crankshaft. When the crankshaft is rotated by the power output shaft of the music box, the seesaw is oscillated back and forth to reciprocate the tappet rods and the ornament thereon alternatively.

DETAILED DESCRIPTION OF THE PREFERRED EMBODIMENT

Figure 1:
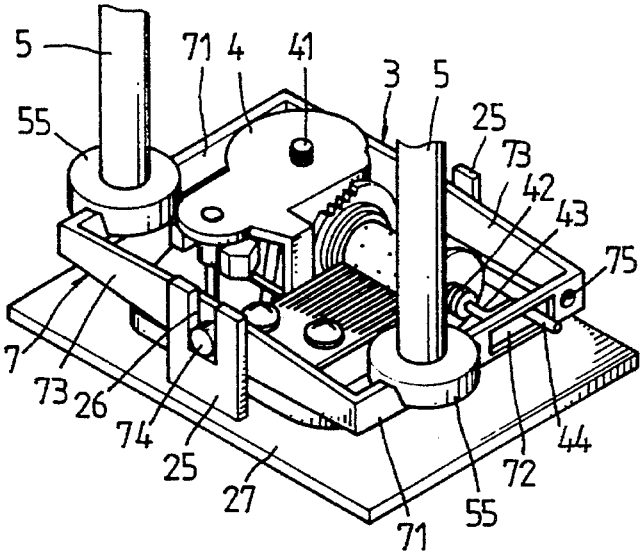
FIG. 1 is an elevational view of a transmission mechanism according to the present invention.
Figure 2:
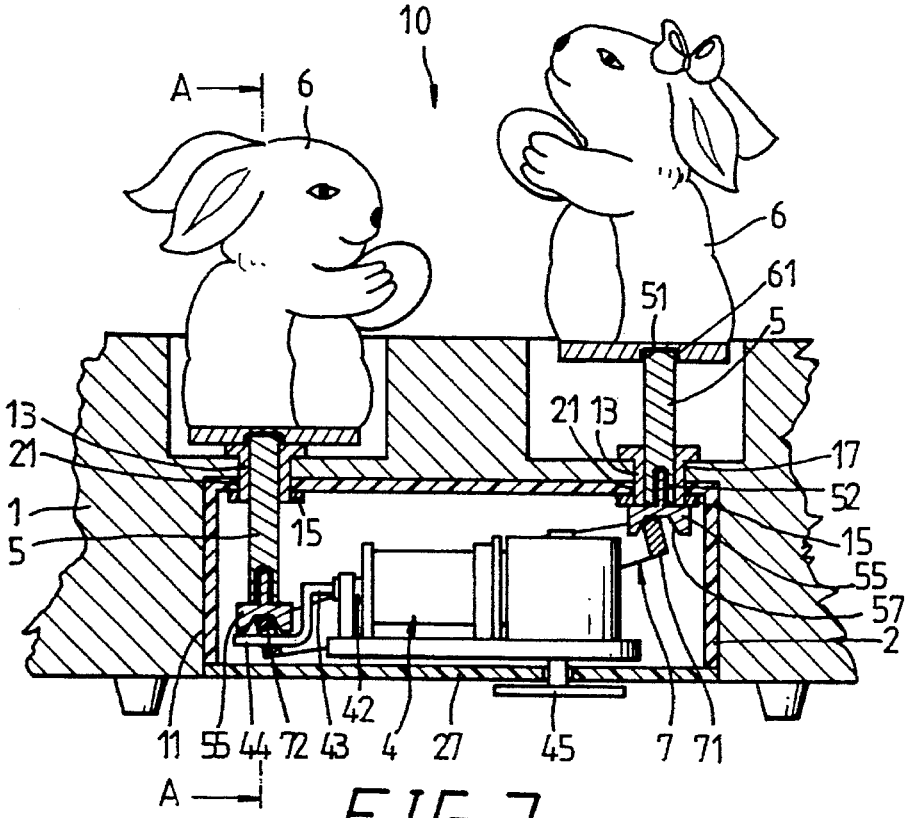
FIG. 2 is a sectional view of a music box display device according to the present invention, showing ornaments coupled to the tappet rods of the transmission mechanism.

Referring to FIGS. 1 and 2, the music box display device, referenced by 10, comprises a housing 1 defining a bottom chamber 11, a case 2 mounted within the bottom chamber 11, a music box 4 and a transmission mechanism 3 mounted in the case 2, and a pair of ornaments 6 supported on a respective tappet rod 5 outside the housing 1. When the music box 4 is operated to play certain tunes, the transmission mechanism 3 is driven by the driving mechanism of the music box 4 to reciprocate the tappet rods 5 and the ornaments 6 on the tappet rods 5.

Figure 3:
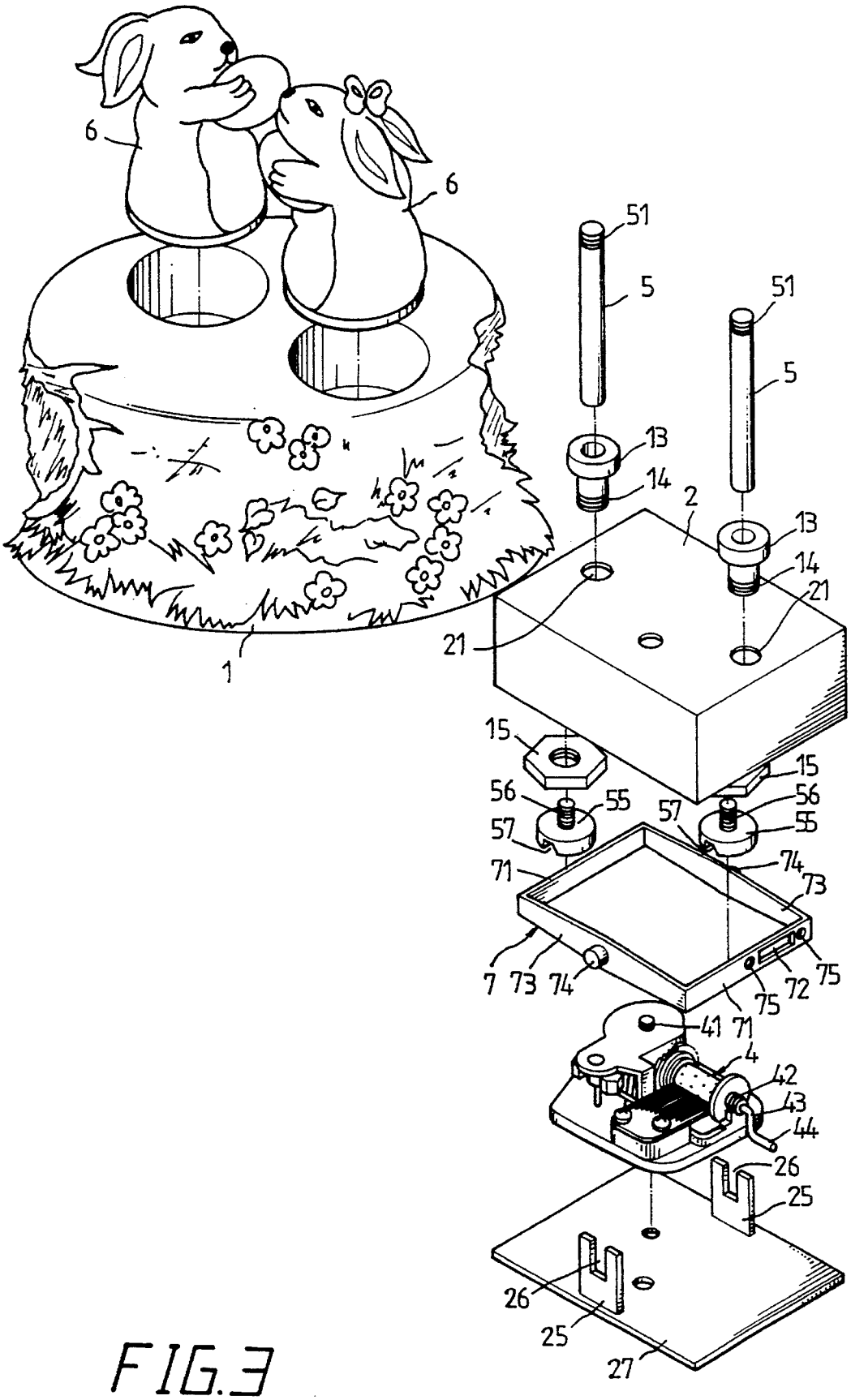
FIG. 3 is an elevational view of the music box display device shown in FIG. 2.
Figure 4:
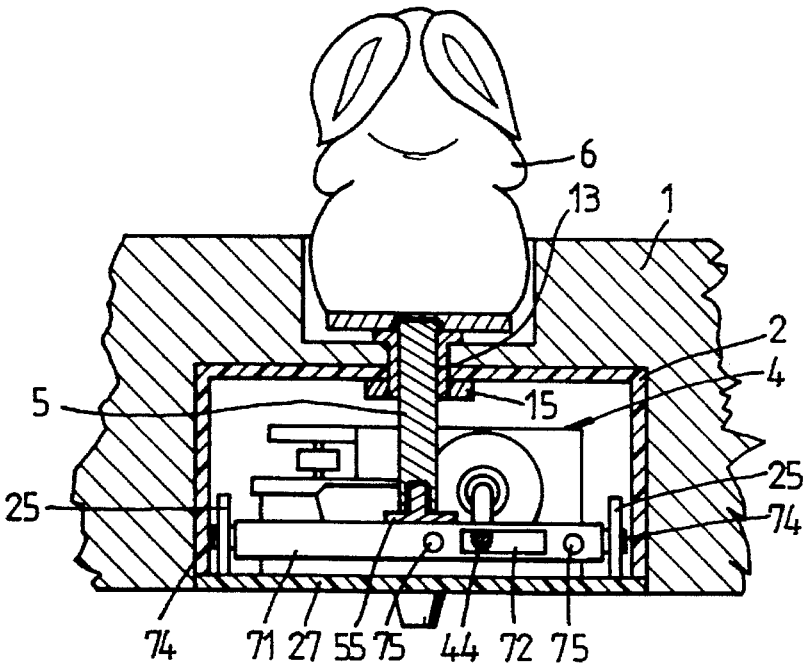
FIG. 4 is a sectional view taken along line A—A of FIG. 2.

Referring to FIG. 3 and FIG. 2 again, each tappet rod 5 is moved in a respective stepped sleeve 13. The stepped sleeve 3 has a threaded bottom end 14 of small diameter inserted through a hole 17 on the housing 1 and a hole 21 on the case 2 and then locked by a respective nut 15. Each tappet rod 5 has a top end terminating in a male thread 51 threaded into a female thread 61 on one ornament 6, and a bottom end terminating in a female thread 52 screwed up with a respective end member 55. The end member 55 has an upright screw rod 56 at the top threaded into the female thread 52 on one tappet rod 5, and a mounting groove 57 at the bottom engaged with one upright wall 71 at one end of a seesaw 7. Therefore, when the seesaw 7 is oscillated back and forth, the tappet rods 5 are alternatively reciprocated to move the ornaments 6.

Referring to FIGS. 1 and 2 again, the music box 4 has a wind-up mechanism 41, and a horizontal power output shaft 42 coupled to the wind-up mechanism 41. A crankshaft 43 is coupled to the power output shaft 42 of the music box 4. The crank 44 of the crankshaft 43 is coupled to a sliding slot 72 on the seesaw 7. The seesaw 7 is made of hollow rectangular shape having two opposite upright short walls 71, two upright long walls 73, a rectangular sliding slot 72 on one upright short wall 71, which is coupled to the crank 44 of the 20 crankshaft 43, and two pivots 74 respectively and outwardly extended from the upright long walls 73 and respectively inserted in the top opening 26 of a respective support 25 on the bottom cover 27 of the case 2 to balance the seesaw 7 inside the case 2.

Referring to FIG. 2, the wind-up mechanism 41 of the music box 4 is operated by the control of a handle 45. When the handle 45 is released from the hand after the wind-up mechanism 41 is wound up, the reproducer of the music box 4 is driven to play certain tunes, and the crankshaft 43 is rotated by the power output shaft 42, causing the seesaw 7 oscillated back and forth by the crank 44, and therefore the tappet rods 5 with the ornaments 6 are reciprocated vertically and alternatively.

Figure 5:
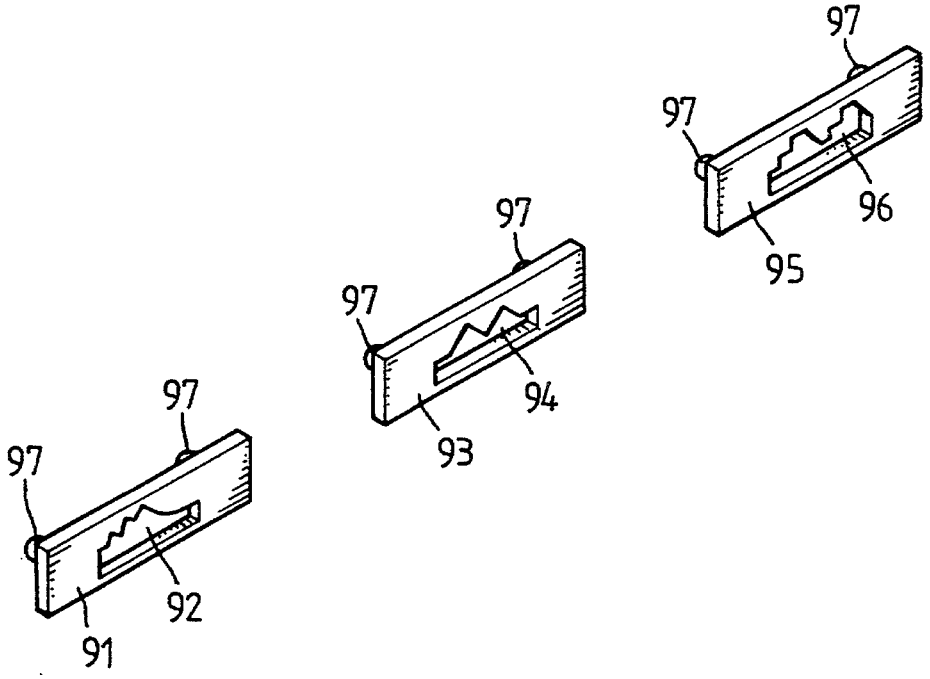
FIG. 5 shows different forms of guide block according to the present invention.

The sliding slot 72 on the seesaw 7 is made of rectangular shape, therefore the tappet rods 5 can only be reciprocated vertically in a straight course. In order to change the movement course of the tappet rods 5, a guide block is needed. FIG. 5 shows various different forms of the guide block. The guide block 91, 93 or 95 has two back pins 97 neat two opposite ends respectively fitted into a respective pin hole 75 on the seesaw 7 (see also FIG. 3), and a curved sliding slot 92, 94, or 96 in the middle aligned with the sliding slot 72 on one upright short wall 71 of the seesaw 7 at an outer side for coupling to the crank 44 of the crankshaft 43. The width of the curved sliding slot 92, 94, and 96 must be smaller than that of the sliding slot 72 on the seesaw 7 so that the crank 44 can be guided by the curved sliding slot 92, 94, or 96 in a curved route.

It will be understood that the drawings are designed for purposes of illustration only, and are not intended as a definition of the limits and scope of the invention disclosed.

I claim:

1. A transmission mechanism for a music box ornament comprising:

a crankshaft coupled to the power output shaft of a music box mounted inside a case within a decorative housing;

a seesaw balanced inside said case within said decorative housing, said seesaw being made of a hollow rectangular shape having two opposite short sides and two opposite long sides defining its border, two opposite upright walls at said two opposite short sides, one upright wall having a rectangular sliding slot; and a pair of tappet rods, each having a top end extended out of said decorative housing to support a respective ornament and a bottom end coupled to one upright wall of said seesaw, said tappet rods being reciprocated vertically and alternatively by said seesaw when said crankshaft is rotated by the power output shaft of said music box to oscillate said seesaw back and forth.

2. The transmission mechanism of claim 1 wherein the bottom end of each tappet rod is coupled to one upright wall of said seesaw by a respective end member, said end member being fixed to one tappet rod by a screw joint and having a bottom mounting groove engaged with one upright wall of said seesaw.

3. The transmission mechanism of claim 1 further comprising a guide block fastened to said seesaw and coupled to said crankshaft, said guide block having two back pins near two opposite ends thereof respectively fitted into a respective pin hole on one upright wall of said seesaw, and a curved sliding slot in the middle aligned with the rectangular sliding slot on said seesaw at an outer side, the width of said curved sliding slot being shorter than that of said rectangular sliding slot.

* * * * *